US006655089B2

(12) United States Patent
Le Gallo

(10) Patent No.: US 6,655,089 B2
(45) Date of Patent: Dec. 2, 2003

(54) DEVICE FOR ELECTRICALLY DRIVING A CABLE-ACTUATED WINDOW REGULATOR

(75) Inventor: Yann Le Gallo, Orleans (FR)

(73) Assignee: Meritor Light Vehicle Systems - France (FR)

( * ) Notice: Subject to any disclaimer, the term of this patent is extended or adjusted under 35 U.S.C. 154(b) by 59 days.

(21) Appl. No.: 10/001,691

(22) Filed: Oct. 23, 2001

(65) Prior Publication Data

US 2002/0046497 A1 Apr. 25, 2002

(30) Foreign Application Priority Data

Oct. 24, 2000 (FR) ..... 00 13600

(51) Int. Cl.[7] ..... E05F 11/48; E05F 15/00
(52) U.S. Cl. ..... 49/352; 49/139; 74/89.14
(58) Field of Search ..... 49/352, 349, 348, 49/139, 140, 425, 89.22, 89.14, 89.15; 74/89.2, 506, 625

(56) References Cited

U.S. PATENT DOCUMENTS 4,085,629 A * 4/1978 Fogarollo ..... 49/139 X
4,194,605 A 3/1980 Sessa
4,503,732 A * 3/1985 Schust ..... 49/352 X
4,534,233 A * 8/1985 Hamaguchi ..... 49/352 X
4,753,125 A * 6/1988 Fukumoto et al. ..... 49/352 X
4,840,080 A * 6/1989 Kobayashi et al. ..... 49/352 X
5,074,077 A * 12/1991 Toyoshima et al. ..... 49/352
5,207,393 A 5/1993 Marscholl

* cited by examiner

*Primary Examiner*—Hugh B. Thompson
(74) *Attorney, Agent, or Firm*—Carlson, Gaskey & Olds

(57) ABSTRACT

A device for electrically driving a cable-actuated window regulator includes a casing and an electric motor. The electric motor drives an endless screw meshing with a toothed ring surrounding a conventional brake box that is connected to a cable winding drum disposed in the housing. The toothed ring presents a frontal wall obturating the opening of a cylindrical sleeve forming the casing of the brake box. The drum and the frontal wall define fingers capable of cooperating with the ends of a helical spring disposed in the cylindrical sleeve.

12 Claims, 1 Drawing Sheet

FIG.1
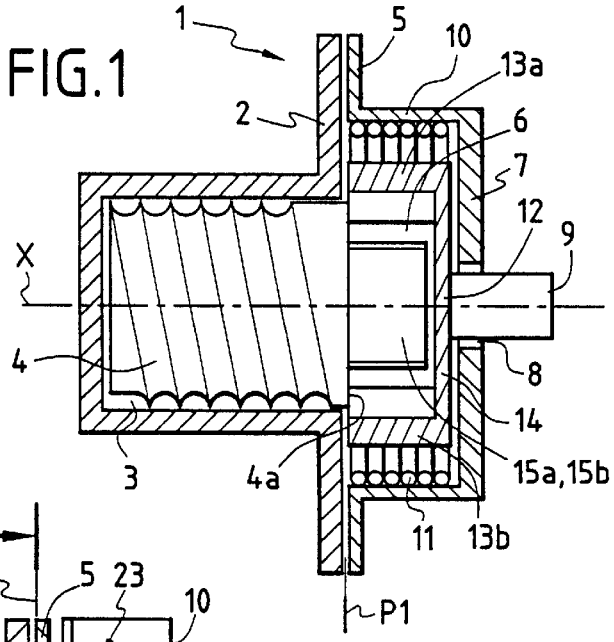
FIG.2
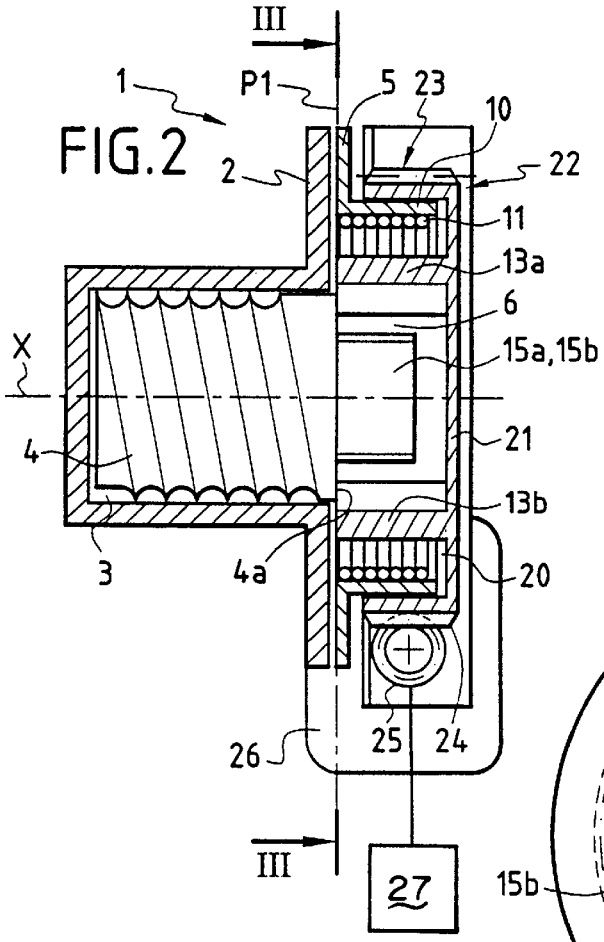
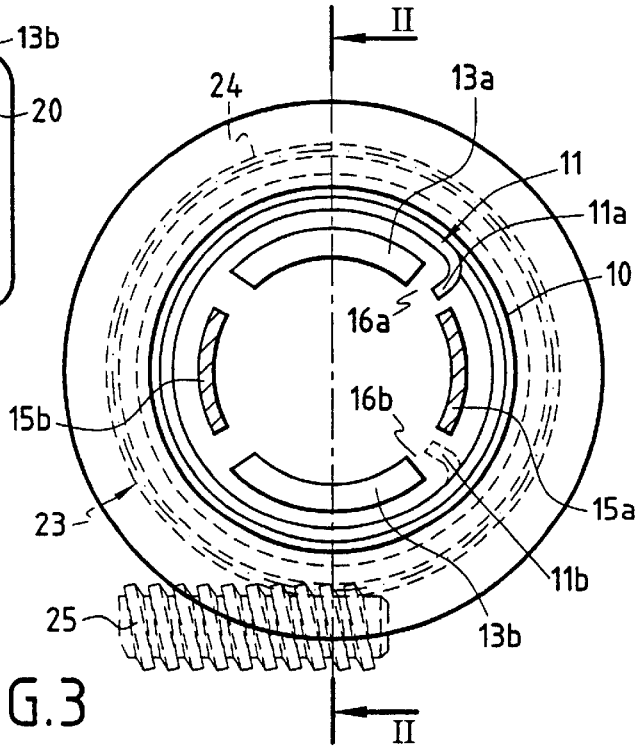
FIG.3

DEVICE FOR ELECTRICALLY DRIVING A CABLE-ACTUATED WINDOW REGULATOR

BACKGROUND OF THE INVENTION

The present invention relates to an electrical drive device for a vehicle window regulator. More precisely, the invention relates to an electrical control of a cable-actuated window regulator which comprises a brake for preventing the reverse movement of the regulator when a force is exerted on the window pane in order to open it.

The irreversibility of the drive device is necessary in order to prevent acts of vandalism not involving breakage of glass or forcing of the locks. In manual drive devices, there is provided between the shaft of the crank and the cable drive drum, an irreversibility device commonly called "brake box", which comprises a helical spring housed in a fixed cylindrical sleeve and whose ends are curved axially inwardly. The drive drum comprises two diametrically opposite axial fingers and the shaft of the crank is also equipped with two diametrically opposite axial fingers interposed with clearance between the fingers of the drum. When a finger of the crank abuts on one spring end, the spring contracts and may rotate freely in the sleeve, this rotating the drum and maneuvering the windowpane.

Inversely, when a force is exerted on the windowpane to open it, for example, a finger of the drive drum abuts on one spring end in the sense of radial expansion thereof. The spring then abuts on the inner wall of the sleeve, and the friction of the spring against the wall brings about a braking of the spring. The forces of friction are calculated so that the spring expanded in the sleeve is immobilized by friction, which prevents the reverse rotation of the crank.

In window regulators actuated by an electric motor, the motor generally drives an endless screw which cooperates with a helicoidally toothing of a wheel. The screw pitch, the shape of the threading and the shape of the toothing are calculated so that, if the drum is urged in rotation by exerting a force on the windowpane, the endless screw is not driven in rotation. The output of the kinematics is low and less than 0.5, in order to ensure irreversibility of the device. The driving torque is therefore high, which brings about high energy consumption.

U.S. Pat. No. 5,207,393 proposed equipping an electrical drive device for the window regulator, with a brake box functionally identical to the brake box of a manual drive device. In this device, the worm wheel driven by the endless screw is disposed between the cable drive drum and the brake box. The fingers of the drum pass through openings made in the wheel and the wheel comprises two opposite sets of axial fingers. One of these sets is disposed in the brake box and the other set is arranged in housings made in the drum and is intended to drive the drum in rotation under the action of the motor. As the wheel is disposed between the drum and the brake box, the dimension of the device proposed by U.S. Pat. No. 5,207,393, in the direction of the axis of rotation, is greater than the dimension of a manual drive device which comprises only a drive drum and a brake box axially connected to the drum. On the other hand, the pieces used, particularly the drive drum and the box, cannot be used equally well for a manual drive device and for an electrical drive device, due to the increase of the axial dimension of the fingers of the drum in the electrical drive device.

On the basis of the state of the art disclosed by U.S. Pat. No. 5,207,393, the first object of the present invention is to propose an electrical drive device for a cable-actuated window regulator equipped with a conventional brake box which presents dimensions which are transversely with respect to the door equipped with the device, and at the most equal to those of a manual drive device.

It is another object of the invention to propose an electrical drive device for window regulator which comprises pieces identical to those of a manual drive device, in order to reduce costs of the tools and the number of pieces in stock.

SUMMARY OF THE INVENTION

An electrical drive device for a cable-actuated window regulator includes a casing, an electric motor mounted on the casing, a cable winding drum mounted to rotate about an axis x in the casing and presenting on one of its faces at least a first axial finger, and a gear wheel mounted to rotate about axis x on the casing and capable of being driven in rotation by the motor, the wheel including at least a second axial finger.

A helical spring of axis x is disposed in a brake box of axis x formed in the casing and includes inwardly curved ends. The first finger and the second finger are disposed in the brake box, are equidistant from axis x, and extend circumferentially with clearance inside the turns of the spring.

The ends of the spring and the fingers are disposed so that, when the motor drives the wheel, the second finger abuts on a spring end to compress it axially so that it can rotate at the same time as the gear wheel. When the drum is urged in rotation, the first finger abuts on a spring end and provokes an axial extension of the spring, preventing the rotation of the wheel further to contact of the spring with the brake box.

The casing includes a cylindrical housing of axis x for receiving the drum and a cylindrical sleeve of axis x open at its end opposite the housing and constituting the brake box. The wheel includes a toothed ring surrounding the sleeve and having a frontal wall obturating the opening of the sleeve. The second finger extends axially from the frontal wall inside the ring.

The axial dimension of the device proposed is thus equal to the dimension of a manual drive device in which the shaft of the crank passes through an opening made in the bottom of the brake box. The drum is identical to that of a manual drive device. The casing of the device proposed is virtually identical to that of the casing of the manual drive device, as, instead of making a hole in the bottom of the brake box for the passage of the shaft of the crank, this bottom is removed to make the opening of the sleeve.

The casing is advantageously produced by stamping a first plate in order to make the housing of the drum and by stamping and cutting out a second plate in order to produce the cylindrical sleeve, the two stamped plates being joined along a plane of join located in the orifice of the drum housing. The inner diameter of the sleeve is preferably greater than the diameter of the drum housing.

According to another advantageous characteristic, the electric motor comprises a drive unit and a hood and the wheel is mounted on the hood. This hood is fixed on the casing.

BRIEF DESCRIPTION OF THE DRAWINGS

The invention will be more readily understood on reading the following description given by way of example and with reference to the accompanying drawings, in which:

FIG. 1 is a section along a plane containing the axis of rotation of a manual drive device of a window regulator;

FIG. 2 is a section along a plane containing the axis of rotation of an electrical drive device according to the invention; and FIG. 3 is a section along line III—III of FIG. 2.

DESCRIPTION OF PREFERRED EMBODIMENT

Referring now to the drawings, FIG. 1 shows a device for manually driving a cable-actuated window regulator which comprises a casing 1 made by stamping two plates, namely a first plate 2 in which a first cylindrical housing 3 of axis x is made by stamping, which is intended to receive a drum 4 for winding the cables maneuvering the window regulator proper, and a second plate 5 in which a second cylindrical housing 6 of axis x is made by stamping. For the sake of clarity, the maneuvering cables and the window regulator have not been shown. The bottom 7 of the second housing 6 comprises a hole 8 of axis x through which the shaft 9 of a crank passes.

The diameter of the second cylindrical housing 6 is greater than the diameter of the first cylindrical housing 3. The two stamped plates 2 and 5 are connected together at the level of a plane of join P1 located in the orifice of the housings 3 and 6. The cylindrical wall 10 of the second housing 6 is capable of cooperating by friction with the turns of a helical spring 11 disposed in the second housing 6 and of which the end portions 11*a* and 11*b* are curved towards the inside of the second housing 6. The end 12 of the crank shaft 9 located in the second housing terminates in a fork which presents two diametrically opposite fingers 13*a* and 13*b* which extend parallel to the axis x inside the turns of the helical spring 11 from a radial wall 14 formed at the end 12 of the shaft 9, and close to the bottom 7 of the second housing 6.

The cable drum 4 also presents on it frontal face 4*a*, opposite the second housing 6, two diametrically opposite fingers 15*a* and 15*b* which extend parallel to axis x in the second housing 6, inside the turns of the helical spring 11. The fingers 13*a* and 13*b* of the shaft 9 and fingers 15*a* and 15*b* of the drum 4 are substantially equidistant from axis x and they extend circumferentially in the form of sectors, as is visible in FIG. 3, variable interstices or clearances being provided between the opposite radial edges of these fingers.

The ends 11*a* and 11*b* of the helical spring 11 are disposed in the interstices 16*a* and 16*b* separating a finger 15*a*, for example, of the drum 4 from the fingers 13*a* and 13*b* of the shaft 9. When the finger 15*a* abuts on one of the ends 11*a* or 11*b* of the helical spring 11 further to a force exerted on the window pane and which urges the drum 4 in rotation, the turns of the spring 11 tend to increase their diameter, and rub against the cylindrical wall 10 of the second housing 6, the spring 11 and the inverse rotation of the shaft 9.

Inversely, when the crank shaft 9 is rotated, one of the fingers 13*a* or 13*b* of the shaft 9 abuts on one of the ends 11*a* or 11*b* of the helical spring 11, which brings about a radial contraction of the turns and allows the spring 11 to rotate freely and without friction against the cylindrical wall 10 about axis x. Rotation of the fingers 13*a* and 13*b* of the shaft 9 about axis x brings about rotation of the fingers 15*a* and 15*b* of the drum 4, as is known to the person skilled in the art.

FIG. 2 shows a device for electrically driving a cable-actuated window regulator according to the invention. Elements identical to those described hereinabove bear the same references. This device also comprises a casing 1 made by stamping two plates, namely a first plate 2 in which a first cylindrical housing 3 of axis x is made by stamping, intended to receive a drum 4 for winding the cables maneuvering the window regulator proper, and a second plate 5 in which a cylindrical sleeve 10 of axis x is made by stamping and cut out, defining a second housing 6 opening out on the side opposite the first cylindrical housing 3 through the opening 20 of the cylindrical sleeve 10.

The inner diameter of the cylindrical sleeve 10 is greater than the diameter of the first cylindrical housing 3. The two stamped plates 2 and 5 are joined together at the level of the plane of join P1 located in the orifice of the first housing 3. The cable drum 4 presents on its frontal face 4*a* opposite the second housing 6, two diametrically opposite fingers 15*a* and 15*b* which extend parallel to axis x in the second housing 6.

It should be noted that the first stamped plate 2 and the cable winding drum 4 of the electrical drive device according to the invention may be absolutely identical to the first stamped plate 2 and drum 4 of the manual drive device described hereinabove. The second stamped plate 5 of the electrical drive device according to the invention is almost identical to the second stamped plate 5 of the manual drive device. Only the bottom 7 of the second stamped plate 2 of the manual drive device is removed by cut out to make the cylindrical sleeve 10 which, functionally, has the same function as the cylindrical braking wall 10 of the manual drive device. The tools for stamping the second plate 2 are identical, only the cut-out tools are different.

The inner wall of the cylindrical sleeve 10 is capable of cooperating by friction with the turns of a helical spring 11 disposed in the second housing 6 and of which the end portions 11*a* and 11*b* are curved towards the inside of the second housing 6. The opening 20 of the cylindrical sleeve 10 is obturated by the frontal wall 21 of the wheel 22 of axis x which comprises a ring 23 surrounding the cylindrical sleeve 10. The ring 23 presents on its periphery a toothing 24 meshing, for example, with an endless screw 25 driven by an electric motor 27 having a drive unit and a hood 26 dismountably fixed for example by screws, on the second stamped plate 5. The wheel 22 is borne by the hood 26.

The diametrically opposite fingers 13*a* and 13*b* extend axially in the second housing 6 from the frontal wall 21 of the wheel 22. In the same way as for the manual drive device, the fingers 13*a* and 13*b* of the wheel 22 and fingers 15*a* and 15*b* of the drum 4 are substantially equidistant from axis x and they extend circumferentially in the form of sectors, as is visible in FIG. 3. Variable interstices or clearances are provided between the opposite radial edges of these fingers. The ends 11*a* and 11*b* of the helical spring 11 are also disposed in the interstices 16*a* and 16*b* separating a finger 15*a* of the drum 4 from the fingers 13*a* and 13*b* of the wheel 22.

Functioning of the brake box of the electrical drive device according to the invention is identical to the functioning of the brake box of the manual drive device described hereinabove in the present specification.

As the irreversibility of the electrical drive device is produced by a brake box similar to the conventional brake box of a manual drive device, the endless screw 25 and the toothing 24 of the wheel 22 no longer need to perform this function. The parameters of the toothings may thus be chosen so as to improve the output of the kinematic chain, increase the speed of lifting or lowering of the window pane, and reduce electrical energy consumption. In particular, the endless screw 25 can be replaced by a pinion meshing with toothing 24.

In the example described above, the casing 1 is made by stamping two plates 2 and 5. One of these plates may obviously be an inner door panel of the vehicle or a dismountable module shaped to produce the housing 3 of the drum or the sleeve 10 of the brake box.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An electrical drive device for a cable-actuated window regulator comprising:

a casing including a cylindrical housing symmetrical about an axis and a cylindrical sleeve symmetrical about the axis and an opening at an end opposite the housing and constituting a brake box symmetrical about the axis;

an electric motor mounted on the casing;

a cable winding drum received in the housing and mounted to rotate about the axis in the casing and presenting on a face at least a first axial finger;

a gear wheel mounted to rotate about the axis on the casing and driven in rotation by the motor and including at least a second axial finger and a toothed ring surrounding the sleeve and having a frontal wall obturating the opening of the sleeve, the at least a second finger extending axially from the frontal wall inside the ring; and a helical spring symmetrical about the axis and disposed in the brake box and including a pair of inwardly curved ends, the at least a first finger and the at least a second finger being disposed in the brake box and equidistant from the axis and extending circumferentially with a clearance inside the spring, the pair of ends of the spring and the fingers being disposed such that when the motor drives the wheel the at least a second finger abuts on one of the pair of ends of the spring to compress the spring axially so that the spring rotates at the same time as the gear wheel and, when the drum is rotated the at least a first finger abuts on one of the pair of ends of the spring and provokes axial extension of the spring which prevents rotation of the wheel further by contact of the spring with the brake box.

2. The device of claim 1, wherein the casing is produced by stamping a first plate to make the housing of the drum and by stamping and cutting out a second plate to make the cylindrical sleeve, the two stamped plates being joined along a plane of join located in an orifice of the drum housing.

3. The device of claim 1, wherein an inner diameter of the sleeve is greater than a diameter of the housing of the drum.

4. The device of claim 1, wherein the electric motor includes a drive unit and a hood, and the wheel is mounted on the hood.

5. The device of claim 4, wherein the hood is fixed on the casing.

6. The device of claim 1, wherein the at least a first finger of the drum is a pair of first diametrically opposite fingers and the at least a second axial finger of the wheel is a pair of second diametrically opposite fingers.

7. A window assembly comprising:

a window;

a cable actuated window regulator to cause movement of the window; and an electrical drive device for the window regulator including a casing including a cylindrical housing symmetrical about an axis and a cylindrical sleeve symmetrical about the axis and an opening at an end opposite the housing and constituting a brake box symmetrical about the axis, an electric motor mounted on the casing, a cable winding drum received in the housing and mounted to rotate about the axis in the casing and presenting on a face at least a first axial finger, a gear wheel mounted to rotate about the axis on the casing and driven in rotation by the motor and including at least a second axial finger and a toothed ring surrounding the sleeve and having a frontal wall obturating the opening of the sleeve, the at least a second finger extending axially from the frontal wall inside the ring, and a helical spring symmetrical about the axis and disposed in the brake box and including a pair of inwardly curved ends, the at least a first finger and the at least a second finger being disposed in the brake box and equidistant from the axis and extending circumferentially with a clearance inside the spring, the pair of ends of the spring and the fingers being disposed such that when the motor drives the wheel the at least a second finger abuts on one of the pair of ends of the spring to compress the spring axially so that the spring rotates at the same time as the gear wheel and, when the drum is rotated the at least a first finger abuts on one of the pair of ends of the spring and provokes axial extension of the spring which prevents rotation of the wheel further by contact of the spring with the brake box.

8. The assembly of claim 7, wherein the casing is produced by stamping a first plate to make the housing of the drum and by stamping and cutting out a second plate to make the cylindrical sleeve, the two stamped plates being joined along a plane of join located in an orifice of the drum housing.

9. The assembly of claim 7, wherein an inner diameter of the sleeve is greater than a diameter of the housing of the drum.

10. The assembly of claim 7, wherein the electric motor includes a drive unit and a hood, and the wheel is mounted on the hood.

11. The assembly of claim 10, wherein the hood is fixed on the casing.

12. The assembly of claim 7, wherein the at least a first finger of the drum is a pair of first diametrically opposite fingers and the at least a second axial finger of the wheel is a pair of second diametrically opposite fingers.

* * * * *